United States Patent [19]

Cherubim

[11] 4,302,147

[45] Nov. 24, 1981

[54] LIGHTWEIGHT RADIAL FLOW FLUID MACHINE WITH FLUID BEARING SEALED FLEXIBLE BLADES

[75] Inventor: Justin L. Cherubim, Flint, Mich.

[73] Assignee: General Motors Corporation, Detroit, Mich.

[21] Appl. No.: 127,727

[22] Filed: Mar. 6, 1980

[51] Int. Cl.[3] ..... F01D 5/04

[52] U.S. Cl. ..... 415/92; 415/120; 415/141; 415/173 R

[58] Field of Search ..... 415/173 R, 173 A, 140, 415/141, 92, 110, 113, 174, 120, 203; 416/240, 197, DIG. 3

[56] References Cited

U.S. PATENT DOCUMENTS

| | | | |
|---|---|---|---|
| 838,358 | 12/1906 | Rotter | 415/173 B |
| 1,671,373 | 10/1927 | Martin | 416/197 |
| 1,868,017 | 8/1931 | McGinty | 415/92 |
| 1,944,987 | 6/1932 | Ljungstrom | 415/141 |
| 2,669,188 | 3/1950 | McIntyre | 415/141 |

*Primary Examiner*—Louis J. Casaregola
*Assistant Examiner*—Jeffrey A. Simenauer
*Attorney, Agent, or Firm*—Robert J. Outland

[57] ABSTRACT

A lightweight fully shrouded radial flow fluid machine comprising a rotor having blades with flexible sides and a closed edge and a housing having opposed walls closely adjacent the flexible sides of the blades, the rotor blades being shaped to coact with the working fluid and adjacent walls of the housing during rotor rotation to develop a fluid dynamic bearing film that supports the blade sides in free-running close clearance with the walls thus sealing the space between the blades and the walls with a minimum of wearing contact.

3 Claims, 4 Drawing Figures

LIGHTWEIGHT RADIAL FLOW FLUID MACHINE WITH FLUID BEARING SEALED FLEXIBLE BLADES

TECHNICAL FIELD

This invention relates to fully shrouded radial flow gas and liquid fluid machines, such as turbines and compressors for turbochargers and the like, and more particularly relates to an improved form of lightweight radial flow turbine or compressor rotor with flexible fluid sealed blades.

BACKGROUND OF THE INVENTION

In the art relating to rotary gas and liquid fluid machines and especially relating to turbines and compressors for automotive engine turbochargers, it is considered that substantial improvements in engine efficiency and performance during transient operation could be made by reducing weight and inertia of the turbine and compressor rotors and by providing improved methods for sealing these rotors against the leakage of pressurized fluids past the rotating blades during operation.

In typical turbine and compressor designs, the weight of the assembly is related to size and weight of the blades and associated portions of the rotor, which are in turn functions of their size and shape and the strengths of the materials from which they are made. Sealing is generally accomplished by providing close clearances between the sides of the blades and the walls of the housing in which they operate. However, these clearances must be adequate to provide for manufacturing tolerances plus the dimensional variations occurring during operation of the unit at various temperatures, since rubbing of the blades on the housing would adversely affect efficiency, as well as causing undesired wear or damage. Where rubbing seals are utilized, their frictional contact will to some extent reduce operating efficiency of the machine.

SUMMARY OF THE INVENTION

The present invention overcomes some of the limitations of prior art devices by providing an exceptionally lightweight rotor for a radial flow fluid machine. Substantial portions of the sealing requirements are provided by flexible rotor blades formed from lightweight sheet or foil materials and arranged to develop fluid dynamic bearing films with the adjacent sides of the housing. These fluid films support the blades in free-running close clearance to the housing, with a minimum clearance space therebetween that acts as a seal.

These and other features and advantages of the invention will be more fully understood from the following description of an exemplary embodiment chosen for purposes of illustration and taken together with the accompanying drawing.

BEST MODE FOR CARRYING OUT THE INVENTION

Figure 1:
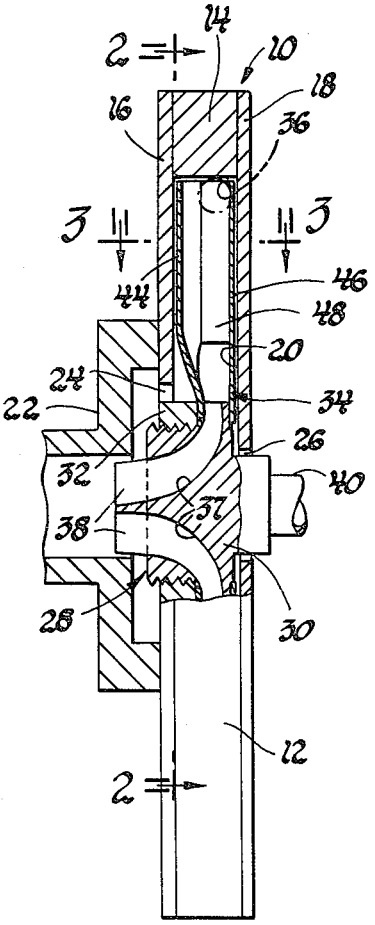
FIG. 1 is a side view partially in cross section of a lightweight radial flow fluid machine turbine formed in accordance with the principles of the invention.
Figure 2:
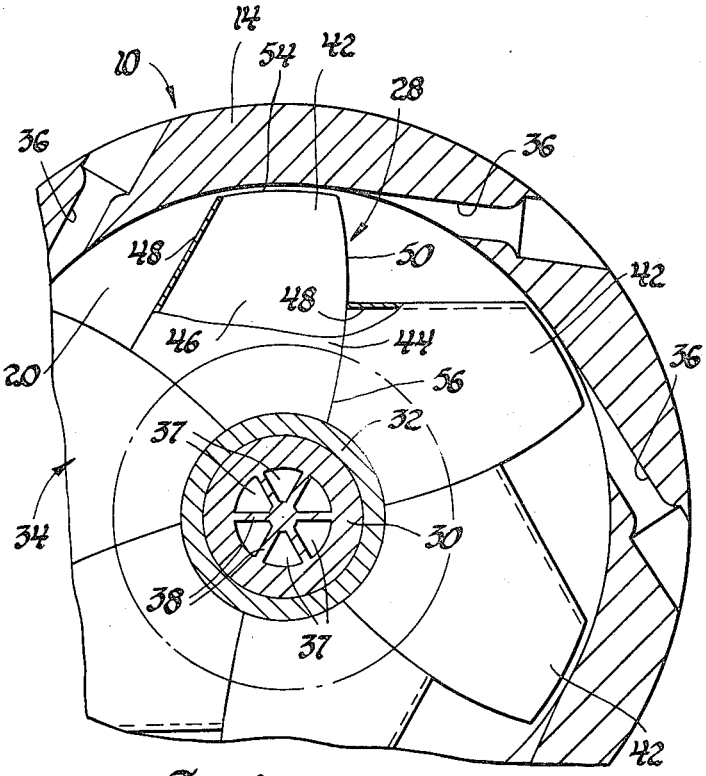
FIG. 2 is a fragmentary cross-sectional view from the plane indicated by the line 2—2 of FIG. 1 showing an end view of the rotor with a portion broken away to disclose the foil blade construction.
Figure 3:
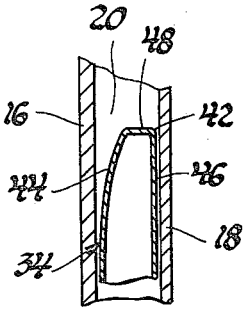
FIG. 3 is a cross-sectional view through one of the blades as seen from the plane indicated by the line 3—3 of FIG. 1.

Referring now in detail to the drawing, wherein is disclosed an embodiment of the invention representing the best mode presently known for carrying out the invention, numeral 10 generally indicates a radial flow turbine of the type adapted for use in driving the compressor of a vehicle engine turbocharger or the like. Turbine 10 includes a housing 12 having a peripheral nozzle ring 14 attached to a pair of stationary walls 16, 18 to define a partially enclosed rotor chamber 20. Wall 16 supports a discharge fitting 22. Central openings 24, 26 are provided in the walls 16, 18, respectively, for purposes to be subsequently described.

Within the housing there is rotatably disposed a lightweight radial flow turbine rotor formed in accordance with the invention and generally indicated by numeral 28. Rotor 28 includes a central threaded hub 30 to which is retained, by a lock ring 32, an impeller blade assembly 34 extending radially within the rotor chamber 20.

The nozzle ring is provided with a plurality of inlet nozzles 36 that direct the working fluid, such as engine exhaust gas, into the rotor chamber in a direction approximately tangential to the inner periphery of the nozzle ring. The hub 30 is provided with a plurality of internal passages 37 having exit vanes 38 to direct the working fluid from the rotor chamber through the wall opening 24 and into the discharge fitting 22. The hub also extends through wall opening 26 and is connected with an output shaft 40 which is driven by the turbine.

Figure 4:
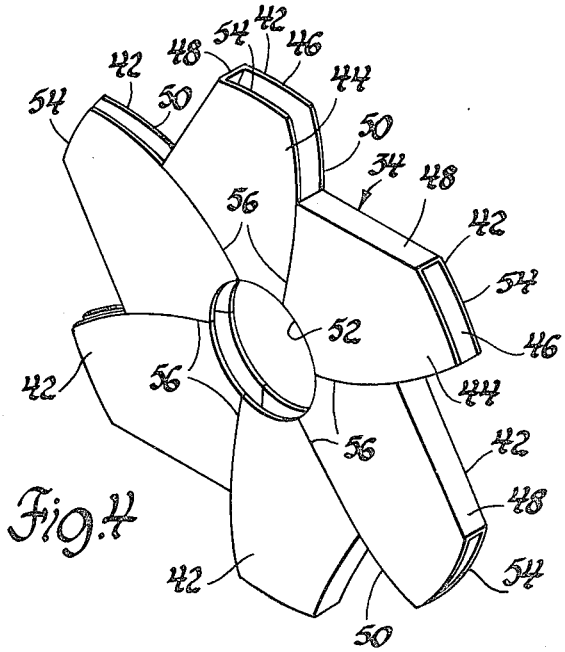
FIG. 4 is a pictorial view of the foil blade portions of the rotor of the illustrated turbine.

The impeller blade assembly 34 is preferably formed of a high-strength foil or thin sheet material such as, for example, stainless steel, titanium, beryllium, or other high-strength metals, although other materials such as plastics or even paper might be utilized in appropriate low temperature applications. Preferably a single sheet of the foil material is formed by folding and cutting into a plurality of attached turbine blades 42, each of which has a pair of spaced flexible sides 44, 46. The sides are connected laterally so as to close one edge 48, which is the leading edge of each blade when the rotor is used as a turbine. The opposite (trailing) edge 50 of each blade is open as are its inner and outer peripheries 52, 54, respectively. The left sides 44 of the turbine blades, as seen in FIGS. 1 and 4, are separated along lines 56 at their open trailing edges 50, which extend to the inner peripheries 52 where they are secured to the hub by the lock ring 32. The other (right) sides 46 of the blades are, however, only partially separated along cutting lines (not shown) at their open trailing edges which extend only part way into the portion adjacent the inner periphery 52, which portion is secured to the hub at its edge near the wall 18.

The resulting impeller blade assembly thus comprises a plurality of blades which are relatively stiff in the radial direction and adjacent their closed edges 48, but are flexible in the axial direction, permitting substantial movement of the sides 44, 46 toward and away from the walls 16, 18 of the housing. The blades are suitably shaped so that, upon rotation of the rotor, the sides of the blades will coact with the adjacent walls of the housing to develop a fluid dynamic bearing film therebetween which will act to draw the blade sides into a close clearance relationship. This clearance may be as small as $10^{-4}$ to $10^{-3}$ inches, thus providing a very effective fluid seal, while developing a bearing force adequate to prevent contact of the sides of the blades with the adjacent housing walls. If desired, the housing may be provided with a spiral groove outward pumping configuration on one wall to act with the opposing sides of the impeller blades, thus providing a thrust bearing on one end of the rotor with the clearance being taken up by the flexibility of the blades on the other end.

In operation, pressurizing fluid, such as engine exhaust gas, is forced through the nozzles 36 of the nozzle ring. It enters peripherally into the chamber 20 where it passes into the open edges 50, 54 of the rotor blades 42 and impinges against the closed edges 48 thereof. This impingement causes rotation of the rotor impeller and directs the entering gas inwardly toward the blade inner peripheries 52 where it passes out of the chamber through the hub exit passages defined by vanes 38.

The pressure of the gas within the blades forces the flexible sides outwardly toward engagement with the adjacent walls 16, 18 of the housing. However, such engagement is prevented by coaction of the blade sides 44, 46 with the adjacent walls 16, 18 of the housing to develop a fluid dynamic bearing film therebetween. This prevents engagement of the blade sides and housing walls and acts as a close clearance seal against the leakage of gas past the blades, so as to aid in the efficient conversion of energy in the supplied gas to rotational energy of the impeller.

Because of the expected high efficiency, rubbing seals should not be required at the openings 24, 26 of the housing, where the gas flow energy is at a minimum. If desired, however, such seals may be utilized for sealing these openings.

While the invention has been described by reference to a specific turbine embodiment, it should be understood that the concepts of the invention may be equally well applied to a radial flow compressor construction. When so applied, however, it will be necessary to properly shape the leading edges of the rotor blades, which in this case will be the open edges, so that they may suitably coact with the walls of the adjacent housing to form the required sealing and supporting fluid dynamic bearing film that prevents rubbing of the blade sides on the housing walls. In other ways, construction and operation of the compressor form of the invention would be similar to that of the turbine form.

While the disclosed embodiment has incorporated for purposes of illustration certain specific features and details of construction, it should be recognized that the principles of the invention illustrated thereby are not limited to the particular embodiment described and it is therefore intended that the invention have the full scope permitted by the language of the following claims.

The embodiments of the invention for which an exclusive property or privilege is claimed are defined as follows:

1. A fluid machine comprising a rotor with a plurality of blades having flexible sides connected axially at one of the leading and trailing edges and open at the other, said blades being operatively attached to a central hub portion rotatable on an axis, the blade sides being free to flex outwardly of said attachment and open for fluid flow between the sides through radially inner and outer peripheries, and a housing at least partially enclosing said rotor, said housing including axially spaced opposed stationary walls each closely adjacent one of the sides of each of said blades and means for passing fluid radially between and through the center and circumference of said housing for reaction with said blades, said blades being shaped to coact with the working fluid and adjacent walls of the housing during rotor rotation to develop a fluid dynamic bearing film that supports the blade sides in free-running close clearance relation to said walls, thus effectively sealing the space between the blades and the walls with a minimum of wearing contact.

2. The machine of claim 1 wherein the rotor blades are integrally connected in an impeller blade assembly formed by folding and cutting a single sheet of flexible material.

3. The machine of claim 1 wherein the blades are formed from a high temperature metallic foil.

* * * * *